US011636830B2

(12) United States Patent
Sun et al.

(10) Patent No.: US 11,636,830 B2
(45) Date of Patent: Apr. 25, 2023

(54) DRIVING METHOD AND APPARATUS OF DISPLAY PANEL

(71) Applicants: Beijing BOE Display Technology Co., Ltd., Beijing (CN); BOE Technology Group Co., Ltd., Beijing (CN)

(72) Inventors: Zhihua Sun, Beijing (CN); Senwang Li, Beijing (CN); Yinlong Zhang, Beijing (CN); Xibin Shao, Beijing (CN); Yanping Liao, Beijing (CN); Feng Qu, Beijing (CN)

(73) Assignees: Beijing BOE Display Technology Co., Ltd., Beijing (CN); BOE Technology Group CO., Ltd., Beijing (CN)

( * ) Notice: Subject to any disclaimer, the term of this patent is extended or adjusted under 35 U.S.C. 154(b) by 31 days.

(21) Appl. No.: 17/412,114

(22) Filed: Aug. 25, 2021

(65) Prior Publication Data

US 2022/0122567 A1 Apr. 21, 2022

(30) Foreign Application Priority Data

Oct. 21, 2020 (CN) ..... 202011134476.6

(51) Int. Cl.
*G09G 5/39* (2006.01)
*G09G 3/20* (2006.01)

(52) U.S. Cl.
CPC ..... *G09G 5/39* (2013.01); *G09G 3/20* (2013.01); *G09G 2360/12* (2013.01)

(58) Field of Classification Search
CPC ..... G09G 5/39; G09G 3/20; G09G 2360/12; G09G 2300/0408; G09G 2310/0224;
(Continued)

(56) References Cited

U.S. PATENT DOCUMENTS

2013/0076805 A1 3/2013 Kajiyama et al.
2014/0085276 A1* 3/2014 Jang ..... G09G 3/2007 345/204

(Continued)

FOREIGN PATENT DOCUMENTS

CN 104570427 A 4/2015
CN 107506161 A 12/2017

(Continued)

OTHER PUBLICATIONS

CN202011134476.6 first office action.
CN202011134476.6 second office action.

*Primary Examiner* — Bryan Earles
(74) *Attorney, Agent, or Firm* — IPro, PLLC

(57) ABSTRACT

The present disclosure discloses a driving method and apparatus of a display panel. When each of a plurality of obtained display frames is transmitted, only display data, corresponding to each pixel in one row group, in the display frame of image data is transmitted to a driving chip in the display panel, so that the driving chip in the display panel drives the display panel to display an image according to the received display data. Therefore, when a system on chip transmits each of the plurality of obtained display frames, only the display data, corresponding to each pixel in one row group, in the display frame of image data is transmitted to the driving chip in the display panel.

10 Claims, 3 Drawing Sheets

(58) Field of Classification Search
CPC ..... G09G 2320/106; G09G 3/2088; G09G 2310/04; G09G 3/3208; G09G 3/3607
See application file for complete search history.

(56) References Cited

U.S. PATENT DOCUMENTS

| | | | | |
|---|---|---|---|---|
| 2015/0070256 | A1* | 3/2015 | Gu | G09G 3/3413 345/88 |
| 2015/0371609 | A1* | 12/2015 | Choi | G09G 5/18 345/205 |
| 2016/0012791 | A1 | 1/2016 | Hsieh et al. | |
| 2017/0148412 | A1 | 5/2017 | Kim et al. | |
| 2017/0352333 | A1* | 12/2017 | Cheng | G09G 3/20 |
| 2018/0047342 | A1* | 2/2018 | Wang | G09G 3/2044 |
| 2018/0130401 | A1 | 5/2018 | Xiang et al. | |
| 2019/0080662 | A1* | 3/2019 | Ahn | G09G 3/3685 |
| 2022/0020133 | A1* | 1/2022 | Chen | G06T 7/001 |
| 2022/0036840 | A1* | 2/2022 | Zhao | G09G 3/3685 |

FOREIGN PATENT DOCUMENTS

| | | | |
|---|---|---|---|
| CN | 107644620 | A | 1/2018 |
| CN | 111292688 | A | 6/2020 |

* cited by examiner

DRIVING METHOD AND APPARATUS OF DISPLAY PANEL

CROSS REFERENCE TO RELATED APPLICATIONS

The present disclosure claims priority to Chinese Patent Application No. 202011134476.6 filed with the China National Intellectual Property Administration on Oct. 21, 2020, the entire contents of which are incorporated herein by its reference.

FIELD

The present disclosure relates to the technical field of display, in particular to a driving method and apparatus of a display panel.

BACKGROUND

A display panel, such as a Liquid Crystal Display (LCD) panel and an Organic Light-Emitting Diode (OLED) display panel, generally includes a plurality of pixels. Each pixel may include: a red sub-pixel, a green sub-pixel and a blue sub-pixel. By controlling display data corresponding to each sub-pixel to control display brightness of each sub-pixel so as to mix a color required to be displayed, a color image is displayed.

SUMMARY

Embodiments of the present disclosure provide a driving method and apparatus of a display panel, used to drive the display panel to display.

An embodiment of the present disclosure provides a driving method of a display panel, wherein the display panel includes a plurality of rows of pixels, the plurality of rows of pixels are divided into N row groups, each of the row groups includes pixels spaced by N−1 rows, and N is an integer greater than 1; and the driving method includes:

obtaining a plurality of continuous display frames of image data to be displayed, wherein each of the plurality of display frames of image data includes display data corresponding to each of the pixels; and in the condition that each of the plurality of display frames is transmitted, transmitting only display data, corresponding to each of the pixels in one of the row groups, of the plurality of display frames of image data to a driving chip in the display panel, so that the driving chip in the display panel drives the display panel to display an image according to the received display data.

In some embodiments, in the condition that each of the plurality of display frames is transmitted, the transmitting only the display data, corresponding to each of the pixels in one of the row groups, in the plurality of display frames of image data to the driving chip in the display panel, includes:

in the condition that the $(N*K-P)^{th}$ display frame in the plurality of display frames is transmitted, transmitting display data corresponding to each of the pixels in an $(N-P)^{th}$ row group in the N row groups of the $(N*K-P)^{th}$ display frame to the driving chip in the display panel, wherein $0 \le P \le N-1$, and K is an integer greater than 0.

In some embodiments, N=2; the 2 row groups include a first row group and a second row group, the first row group includes odd rows of pixels, and the second row group includes even rows of pixels; and in the condition that the $(2K)^{th}$ display frame in the plurality of display frames is transmitted, transmitting display data corresponding to each of the pixels in the second row group to the driving chip in the display panel; and in the condition that the $(2K-1)^{th}$ display frame in the plurality of display frames is transmitted, transmitting display data corresponding to each of the pixels in the first row group to the driving chip in the display panel.

In some embodiments, after the plurality of continuous display frames of image data to be displayed are obtained and before only the display data, corresponding to each of the pixels in one of the row groups, in the display frame of image data is transmitted to the driving chip in the display panel in the condition that each of the plurality of display frames is transmitted, the method further includes: determining the quantity of display frames corresponding to static images and the quantity of display frames corresponding to dynamic images in a plurality of adjacent display frames in the plurality of display frames; and in the condition that each of the plurality of display frames is transmitted, transmitting only the display data, corresponding to each of the pixels in one of the row groups, in the display frame of image data to the driving chip in the display panel, includes: in the condition that it is determined that the quantity of the display frames corresponding to the dynamic images is greater than the quantity of the display frames corresponding to the static images, in the condition that each of the plurality of display frames is transmitted, transmitting only the display data corresponding to each of the pixels in the one group to the driving chip in the display panel.

In some embodiments, the driving, by the driving chip in the display panel, the display panel to display the image according to the received display data, includes:

at an $(N*K-P)^{th}$ display frame, determining, by the driving chip, display data corresponding to pixels other than the $(N-P)^{th}$ row group in the display panel, wherein $0 \le P \le N-1$, and K is an integer greater than 0; and driving, by the driving chip, the display panel to display an image at the $(N*K-P)^{th}$ display frame according to the received display data corresponding to the $(N-P)^{th}$ row group and the determined display data.

In some embodiments, N=2; the 2 row groups include a first row group and a second row group, the first row group includes the odd rows of pixels, and the second row group includes the even rows of pixels; and at the $(N*K-P)^{th}$ display frame, determining, by the driving chip, the display data corresponding to the pixels other than the $(N-P)^{th}$ row group in the display panel, includes:

at a $(2K-1)^{th}$ display frame, determining, by the driving chip, display data corresponding to each of the pixels in the second row group as display data corresponding to an upper row of pixels adjacent to each pixel in the second row group according to received display data of the $(2K-1)^{th}$ display frame; or at a $(2K-1)^{th}$ display frame, determining, by the driving chip, display data corresponding to each of the pixels in the second row group as data obtained by weighting display data corresponding to an upper row of pixels adjacent to each pixel in the second row group and display data corresponding to a lower row of pixels adjacent to each pixel in the second row group according to the received display data of the $(2K-1)^{th}$ display frame; or apart from a first display frame, at a $(2K-1)^{th}$ display frame, determining, by the driving chip, display data corresponding to each of the pixels in the second row group as display data of a $(2K-2)^{th}$ display frame according to received display data of the $(2K-2)^{th}$ display frame.

In some embodiments, N=2; the 2 row groups include the first row group and the second row group, the first row group includes the odd rows of pixels, and the second row group includes the even rows of pixels; and at the $(N*K-P)^{th}$ display frame, determining, by the driving chip, the display data corresponding to the pixels other than the $(N-P)^{th}$ row group in the display panel, includes:

at a $(2K)^{th}$ display frame, determining, by the driving chip, display data corresponding to each of the pixels in the first row group as display data corresponding to a lower row of pixels adjacent to each pixel in the first row group according to received display data of the $(2K)^{th}$ display frame; or at a $(2K)^{th}$ display frame, determining, by the driving chip, display data corresponding to each of the pixels in the first row group as data obtained by weighting display data corresponding to an upper row of pixels adjacent to each pixel in the first row group and display data corresponding to a lower row of pixels adjacent to each pixel in the first row group according to the received display data of the $(2K)^{th}$ display frame; or at a $(2K)^{th}$ display frame, determining, by the driving chip, display data corresponding to each of the pixels in the first row group as display data of a $(2K-1)^{th}$ display frame according to received display data of the $(2K-1)^{th}$ display frame.

An embodiment of the present disclosure provides a driving apparatus of a display panel, wherein the display panel includes a plurality of rows of pixels, the plurality of rows of pixels are divided into N row groups, each of the row groups includes pixels spaced by N−1 rows, N is an integer greater than 1; and the driving apparatus includes:

a data obtaining circuit, configured to obtain a plurality of continuous display frames of image data to be displayed, wherein each of the plurality of display frames of image data includes display data corresponding to each of the pixels; and a data transmission circuit, configured to, in the condition that each of the plurality of display frames is transmitted, transmit only display data, corresponding to each of the pixels in one of the row groups, of the plurality of display frames of image data to a driving chip in the display panel, so that the driving chip in the display panel drives the display panel to display an image according to received display data.

An embodiment of the present disclosure provides a display apparatus, including a display panel and the above driving apparatus.

An embodiment of the present disclosure provides a computer readable storage medium, storing a computer program thereon, wherein the driving method of the display panel is implemented when the computer program is executed by a processor.

An embodiment of the present disclosure provides a computer device, including a memory, a processor and a computer program stored on the memory and capable of running on the processor, wherein the driving method of the display panel is implemented when the computer program is executed by the processor.

DETAILED DESCRIPTION OF THE EMBODIMENTS

Figure 1:
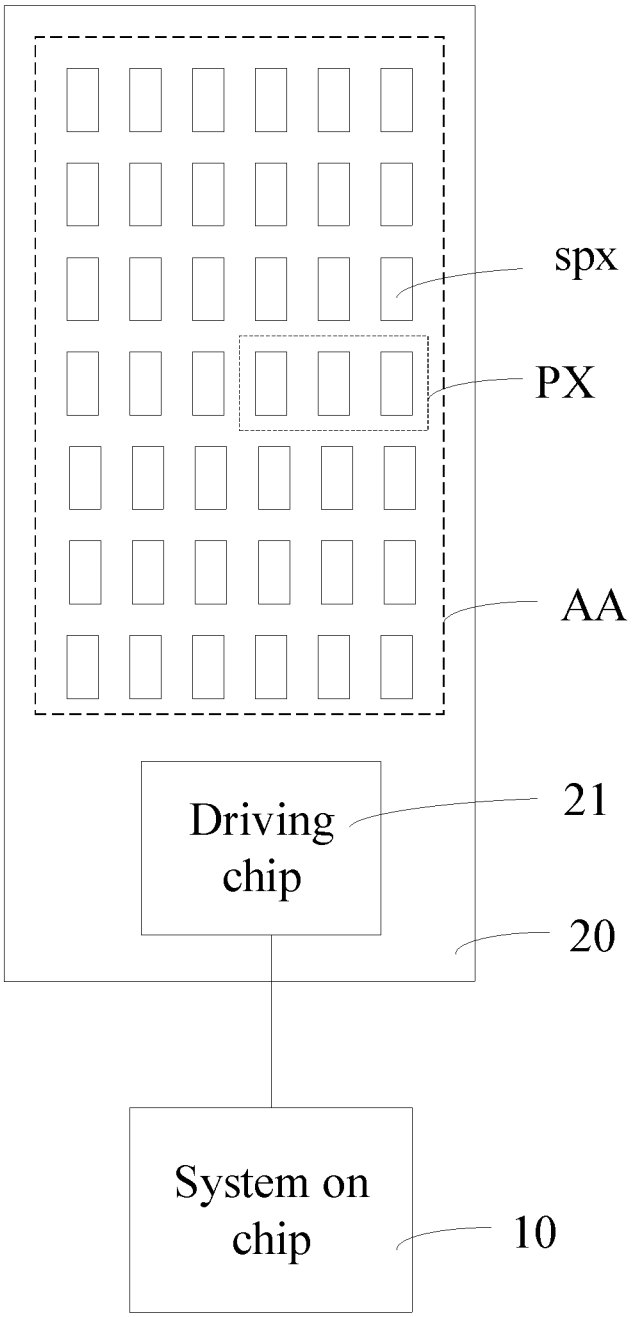
FIG. 1 is a schematic structural diagram of a display apparatus in an embodiment of the present disclosure.

In order to make the objectives, technical solutions and advantages of embodiments of the present disclosure clearer, the technical solutions of the embodiments of the present disclosure will be clearly and completely described below in conjunction with the accompanying drawings of the embodiments of the present disclosure. Apparently, the described embodiments are only a part of the embodiments of the present disclosure, not all of the embodiments. The embodiments in the present disclosure and features in the embodiments can be combined with each other in the case of not conflicting. Based on the described embodiments of the present disclosure, all other embodiments obtained by those of ordinary skill in the art without creative work shall fall within the protection scope of the present disclosure.

Unless otherwise defined, technical or scientific terms used in the present disclosure shall have the ordinary meanings understood by those ordinarily skilled in the art to which the present disclosure pertains. The words "first", "second" and the like used in the present disclosure do not indicate any order, quantity or importance, but are only configured to distinguish different components. The words "comprise" or "include" and the like indicate that an element or item appearing before such the word covers listed elements or items appearing after the word and equivalents thereof, and does not exclude other elements or items. The words "connect" or "couple" and the like are not limited to physical or mechanical connection, but may include electrical connection, whether direct or indirect.

It needs to be noted that the sizes and shapes of all figures in the accompanying drawings do not reflect true scales, and are only intended to schematically illustrate the content of the present disclosure. The same or similar reference numerals represent the same or similar elements or elements with the same or similar functions all the time.

As shown in FIG. 1, a display apparatus is provided with a System On Chip (SOC) 10 and a display panel 20. The display panel is generally provided with a driving chip 21. Moreover, a display region AA of the display panel includes a plurality of pixels PX distributed in an array. That is, the pixels PX are repeatedly arrayed in the display region AA in a row direction and a column direction. In some embodiments, each of the pixels PX includes a plurality of sub-pixels spx. In some embodiments, the pixels PX may include red sub-pixels, green sub-pixels and blue sub-pixels, and therefore red, green and blue may be mixed to achieve color display. Or, the pixels may also include red sub-pixels, green sub-pixels, blue sub-pixels and white sub-pixels, and therefore red, green, blue and white may be mixed to achieve color display. Of course, in practical application, a light emitting color of the sub-pixels in the pixels may be designed and determined according to practical application environments, which is not limited here.

In some embodiments, the display panel may be a liquid crystal display panel or an electroluminescent display panel. The electroluminescent display panel may be an organic light-emitting diode display panel or a quantum-dot light-emitting diode display panel, which is not limited here.

In practical application, the SOC obtains a video with a plurality of continuous display frames of image data, and each display frame of image data may control the display panel to display one image. In practical application, when the display panel is controlled to display one image, the SOC needs to transmit this display frame of image data totally to the driving chip in the display panel, so that the driving chip drives the display panel to display the image according to the image data transmitted by the SOC. However, with the increasing resolution of the display panel, a required refreshing frequency is also higher and higher, which leads to the increasing data size of one display frame of image data transmitted by the SOC to the driving chip, so that a data transmission quantity of the SOC is increased and the requirement for a data transmission rate is higher and higher. Even when the transmission rate of the SOC does not meet the requirement, pictures displayed by the display panel will have the phenomenon of lagging.

Figure 2:
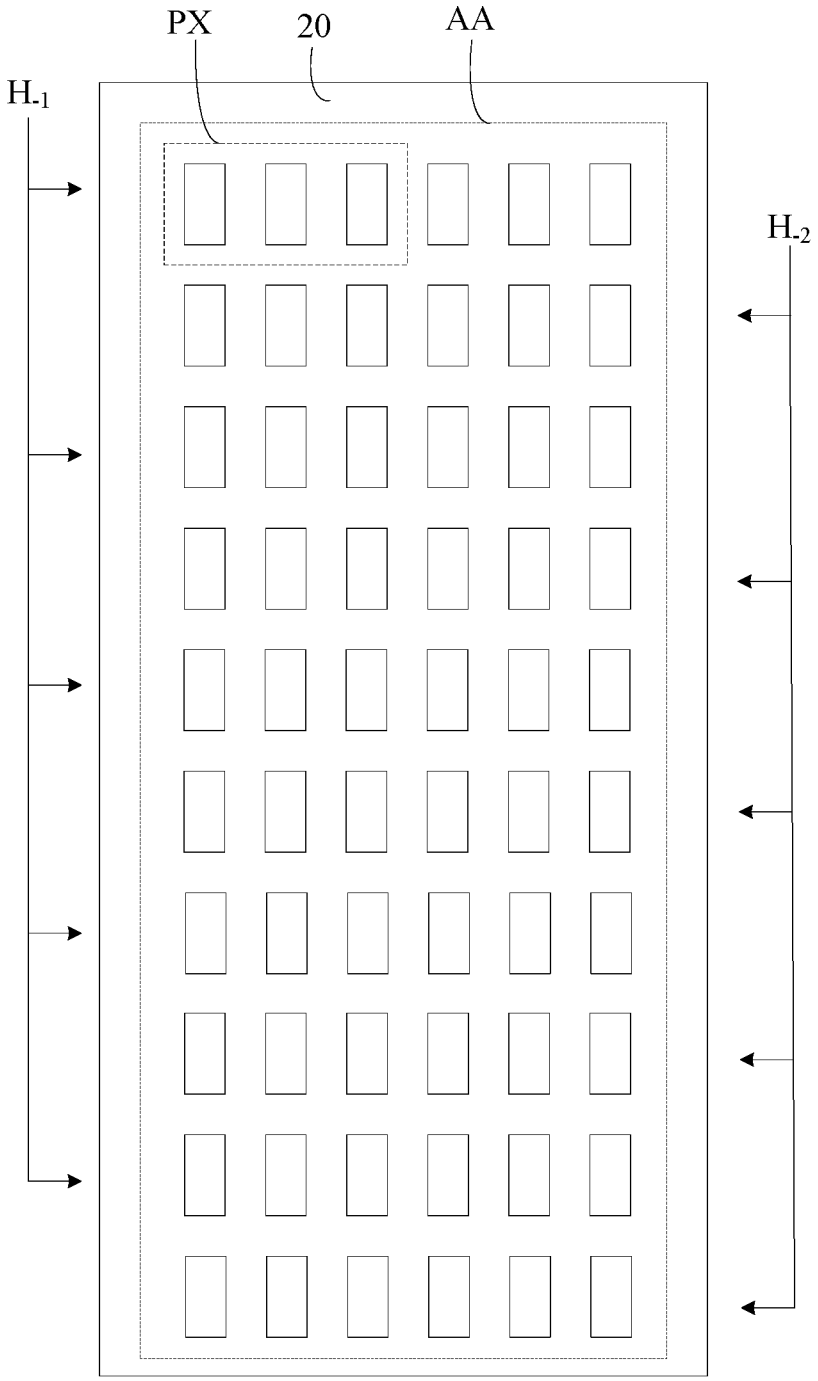
FIG. 2 is a schematic structural diagram of a display panel in an embodiment of the present disclosure.

In embodiments of the present disclosure, the display panel includes a plurality of rows of pixels. The plurality of rows of pixels are divided into N row groups $H_{-n}$ ($1 \leq n \leq N$, n is an integer and N is an integer greater than 1), and each row group includes pixels spaced by N−1 rows. In some embodiments, as shown in FIG. 2, N may be equal to 2, so that the plurality of rows of pixels may be divided into 2 row groups including a first row group $H_{-1}$ and a second row group $H_{-2}$. The first row group $H_{-1}$ includes odd rows of pixels, and the second row group $H_{-2}$ includes even rows of pixels. Or, N may be equal to 3, so that the plurality of rows of pixels may be divided into 3 row groups including a first row group $H_{-1}$, a second row group $H_{-2}$ and a third row group $H_{-3}$. The first row group $H_{-1}$ includes the $(3Y-2)^{th}$ row of pixels, the second row group $H_{-2}$ includes the $(3Y-1)^{th}$ row of pixels, and the third row group $H_{-3}$ includes the $(3Y)^{th}$ row of pixels. Or, N may be equal to 4, so that the plurality of rows of pixels may be divided into 4 row groups which may include a first row group $H_{-1}$, a second row group a third row group $H_{-3}$ and a fourth row group $H_{-4}$. The first row group $H_{-1}$ includes the $(4Y-3)^{th}$ row of pixels, the second row group $H_{-2}$ includes the $(4Y-2)^{th}$ row of pixels, the third row group $H_{-3}$ includes the $(4Y-1)^{th}$ row of pixels, and the fourth row group $H_{-4}$ includes the $(4Y)^{th}$ row of pixels. Y is an integer greater than 0. H represents a drawing numeral. In practical application, a specific value of N may be designed and determined according to the requirements of the practical application, which is not limited here.

Figure 3:
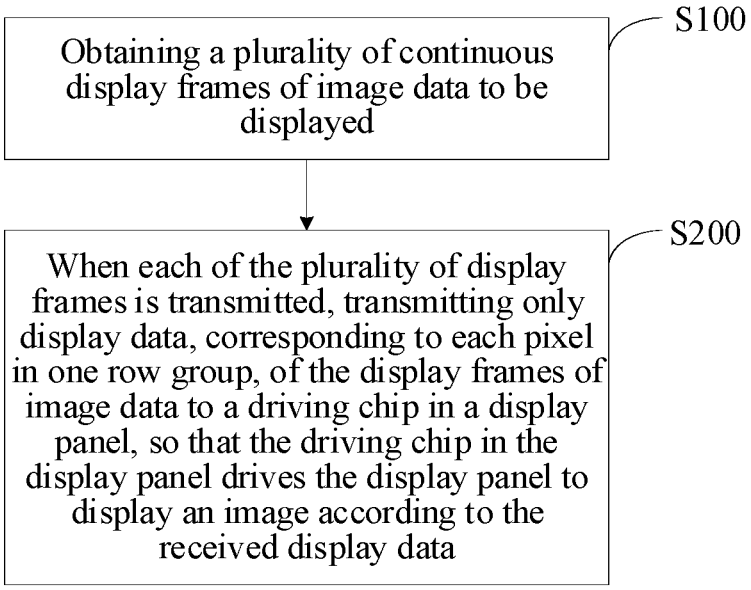
FIG. 3 is a flow chart of a driving method in an embodiment of the present disclosure.

A driving method provided by an embodiment of the present disclosure, as shown in FIG. 3, may include the following steps.

S100, a plurality of continuous display frames of image data to be displayed are obtained. Each display frame of image data includes display data corresponding to each of the pixels.

S200, in a condition that each of the plurality of display frames is transmitted, only display data, corresponding to each pixel in one row group, in the display frames of image data is transmitted to the driving chip in the display panel, so that the driving chip in the display panel drives the display panel to display an image according to the received display data.

According to the driving method provided by the embodiment of the present disclosure, when each of the plurality of obtained display frames is transmitted, only the display data, corresponding to each pixel in one row group, in the display frames of image data is transmitted to the driving chip in the display panel, so that the driving chip in the display panel drives the display panel to display the image according to the received display data. Therefore, when the SOC transmits each of the plurality of obtained display frames, only the display data, corresponding to each pixel in one row group, in the display frame of image data is transmitted to the driving chip in the display panel, so that the data size transmitted to the driving chip in the display panel may be reduced, and when a transmission rate of the SOC does not meet requirements, the phenomenon of lagging of pictures displayed by the display panel is improved.

In the embodiment of the present disclosure, in the condition that each of the plurality of display frames is transmitted, only transmitting the display data, corresponding to each pixel in one row group, in the display frame of image data to the driving chip in the display panel, may include: in the condition that the $(N*K-P)^{th}$ display frame in the plurality of display frames is transmitted, display data, corresponding to each of the pixels in the $(N-P)^{th}$ row group in N row groups, of the $(N*K-P)^{th}$ display frame is transmitted to the driving chip in the display panel. $0 \leq P \leq N-1$, and K is an integer greater than 0.

In some embodiments, when N=2, P may be 0 or 1. The 2 row groups include the first row group $H_{-1}$ and the second row group $H_{-2}$. When the $(2K)^{th}$ display frame in the plurality of display frames is transmitted, display data corresponding to each of the pixels in the second row group is transmitted to the driving chip in the display panel. That is, when the $(2K)^{th}$ display frame in the plurality of display frames are transmitted, display data corresponding to each of the pixels in the even rows is transmitted to the driving chip in the display panel, so that the driving chip in the display panel drives the display panel to display an image according to the received display data. When the $(2K-1)^{th}$ display frame in the plurality of display frames is transmitted, display data corresponding to each of the pixels in the first row group is transmitted to the driving chip in the display panel. That is, when the $(2K-1)^{th}$ of display frames in the plurality of display frames are transmitted, display data corresponding to each pixel in the odd rows is transmitted to the driving chip in the display panel, so that the driving chip in the display panel drives the display panel to display an image according to the received display data.

In some embodiments, when N=3, P may be 0 or 1 or 2. The 3 row groups include the first row group $H_{-1}$, the second row group $H_{-2}$ and the third row group $H_{-3}$. When the $(3K)^{th}$ display frame in the plurality of display frames is transmitted, display data corresponding to each pixel in the third row group is transmitted to the driving chip in the display panel, so that the driving chip in the display panel drives the display panel to display an image according to the received display data. When the $(3K-1)^{th}$ display frame in the plurality of display frames is transmitted, display data corresponding to each pixel in the second row group is transmitted to the driving chip in the display panel, so that the driving chip in the display panel drives the display panel to display an image according to the received display data. When the $(3K-2)^{th}$ display frame in the plurality of display frames is transmitted, display data corresponding to each of the pixels in the first row group is transmitted to the driving chip in the display panel, so that the driving chip in the display panel drives the display panel to display an image according to the received display data.

In some embodiments, when N=4, P may be 0 or 1 or 2 or 3. The 4 row groups include the first row group $H_{-1}$, the second row group $H_{-2}$, the third row group $H_{-3}$ and the fourth row group $H_{-4}$. When the $(4K)^{th}$ display frame in the plurality of display frames is transmitted, display data corresponding to each pixel in the fourth row group is transmitted to the driving chip in the display panel, so that the driving chip in the display panel drives the display panel to display an image according to the received display data. When the $(4K-1)^{th}$ display frame in the plurality of display frames is transmitted, display data corresponding to each pixel in the third row group is transmitted to the driving chip in the display panel, so that the driving chip in the display panel drives the display panel to display an image according to the received display data. When the $(4K-2)^{th}$ display frame in the plurality of display frames is transmitted, display data corresponding to each pixel in the second row group is transmitted to the driving chip in the display panel, so that the driving chip in the display panel drives the display panel to display an image according to the received display data. When the $(4K-3)^{th}$ display frame in the plurality of display frames is transmitted, display data corresponding to each pixel in the first row group is transmitted to the driving chip in the display panel, so that the driving chip in the display panel drives the display panel to display an image according to the received display data.

In the embodiment of the present disclosure, after the plurality of continuous display frames of image data to be displayed are obtained and before only the display data, corresponding to each pixel in one row group, in the display frame of image data is transmitted to the driving chip in the display panel when each of the plurality of display frames is transmitted, the method may further include: the quantity of display frames corresponding to static images and the quantity of display frames corresponding to dynamic images in a plurality of adjacent display frames in the plurality of display frames are determined. In some embodiments, the plurality of adjacent display frames in the plurality of display frames may be M adjacent display frames in the plurality of display frames, and M may be 2, or 6, or 10, or 20 or be equal to the quantity of the plurality of obtained display frames. Moreover, the plurality of obtained continuous display frames of image data to be displayed is greater than M. It needs to be noted that the quantity of the display frames corresponding to the static images refers to the quantity of images that are identical or substantially similar displayed by the display panel according to the display frames of display data. The quantity of the display frames corresponding to the dynamic images refers to the quantity of images that are obviously different from each other or are neither the same nor similar displayed by the display panel according to the display frames of display data.

In some embodiments, when each of the plurality of display frames is transmitted, only transmitting the display data, corresponding to each pixel in one row group, in the display frame of image data to the driving chip in the display panel, may include: when it is determined that the quantity of the display frames corresponding to the dynamic images is greater than the quantity of the display frames corresponding to the static images, when each of the plurality of display frames is transmitted, only the display data corresponding to each pixel in the one row group is transmitted to the driving chip in the display panel. In this way, when the quantity of the display frames corresponding to the dynamic images is greater than the quantity of the display frames corresponding to the static images, it shows that the quantity of the dynamic images is large, and by the way of reducing the transmitted data size, the data transmission rate may be improved, and a display effect may be enhanced. When the quantity of the display frames corresponding to the static images is greater than the quantity of the display frames corresponding to the dynamic images, it shows that the quantity of the static images is large, and the display effect of the display panel may be guaranteed without additionally reducing the transmitted data size.

In the embodiments of the present disclosure, the driving chip in the display panel drives the display panel to display the image according to the received display data may by the following.

At the $(N*K-P)^{th}$ display frame, the driving chip determines display data corresponding to pixels other than the $(N-P)^{th}$ row group in the display panel. $0 \le P \le N-1$, and K is an integer greater than 0.

The driving chip drives the display panel to display an image at the $(N*K-P)^{th}$ display frame according to the received display data corresponding to the $(N-P)^{th}$ row group and the determined display data.

A working process of the above driving method is described through embodiments by taking N=2 as an example.

In some embodiments of the present disclosure, at the $(N*K-P)^{th}$ display frame, the driving chip determines the display data corresponding to the pixels other than the $(N-P)^{th}$ row group in the display panel by the following step. At the $(2K-1)^{th}$ display frame, the driving chip determines display data corresponding to each pixel in the second row group as display data corresponding to the upper row of pixels adjacent to each pixel in the second row group according to received display data of the $(2K-1)^{th}$ display frame.

At the $(N*K-P)^{th}$ display frame, the driving chip determines the display data corresponding to the pixels other than the $(N-P)^{th}$ row group in the display panel by the following step. At the $(2K)^{th}$ display frame, the driving chip determines display data corresponding to each pixel in the first row group as display data corresponding to the lower row of pixels adjacent to each pixel in the first row group according to received display data of the $(2K)^{th}$ display frame.

A driving method provided by the embodiment of the present disclosure includes the following steps.

(1) A plurality of continuous display frames of image data to be displayed are obtained.

In some embodiments, each display frame of image data includes display data corresponding to each pixel. Since each pixel includes a plurality of sub-pixels, the display data of the pixel may include display data corresponding to each sub-pixel in the pixel.

Gray scale is that the brightness change range between the darkest and the brightest is divided into a plurality of parts to facilitate screen brightness control. For example, a displayed image generally may be composed of red, green and blue which are mixed to form a color image, each color may present different brightness levels, and red, green and blue of different brightness levels can be combined to form different color points. The gray scale represents different brightness levels between the darkest and the brightest. The more levels therebetween, the finer the presented image. Generally, image display may be implemented by adopting a 6 bit ($2^6$ brightness levels, namely 64 gray scales) panel, a 7 bit ($2^7$ brightness levels, namely 128 gray scales) panel, a 8 bit ($2^8$ brightness levels, namely 256 gray scales) panel, a 10 bit ($2^{10}$ brightness levels, namely 1024 gray scales) panel, a 12 bit ($2^{12}$ brightness levels, namely 4096 gray scales) panel, or a 16 bit ($2^{16}$ brightness levels, namely 65536 gray scales) panel.

In some embodiments, the display data corresponding to the sub-pixel may be gray scale data corresponding to the brightness of the gray scale to be displayed by the sub-pixel.

(2) The quantity of display frames corresponding to static images and the quantity of display frames corresponding to dynamic images in a plurality of adjacent display frames in a plurality of display frames are determined.

(3) When it is determined that the quantity of the display frames corresponding to the dynamic images is greater than the quantity of the display frames corresponding to the static images, when the first display frame in the plurality of display frames is transmitted, display data corresponding to each pixel in the first row group is transmitted to the driving chip in the display panel.

(4) The driving chip determines display data corresponding to each pixel in the second row group as display data corresponding to an upper row of pixels adjacent to each pixel in the second row group according to the received display data of the first display frame.

In some embodiments, display data corresponding to each pixel in the second row of pixels may be set as display data corresponding to an upper row of pixels adjacent to the second row of pixels. That is, in one same column, the display data corresponding to the pixels in the second row of pixels may be set as display data corresponding to the first row of pixels. In some embodiments, in one same column, display data corresponding to sub-pixels in the second row of pixels may be set as display data corresponding to sub-pixels in the first row of pixels.

Display data corresponding to each pixel in the fourth row of pixels may be set as display data corresponding to an upper row of pixels adjacent to the fourth row of pixels. That is, in one same column, the display data corresponding to the pixels in the fourth row of pixels may be set as display data corresponding to the third row of pixels. In some embodiments, in one same column, display data corresponding to sub-pixels in the fourth row of pixels may be set as display data corresponding to sub-pixels in the third row of pixels.

The remaining is in the same way and so on, which is not repeated here.

(5) The driving chip drives the display panel to display the first image at the first display frame according to the received display data corresponding to the first row group and the determined display data corresponding to the second row group.

(6) When it is determined that the quantity of the display frames corresponding to the dynamic images is greater than the quantity of the display frames corresponding to the static images, when the second display frame in the plurality of display frames is transmitted, display data corresponding to each pixel in the second row group is transmitted to the driving chip in the display panel.

(7) The driving chip determines display data corresponding to each pixel in the first row group as display data corresponding to a lower row of pixels adjacent to each pixel in the first row group according to the received display data of the second display frame.

In some embodiments, display data corresponding to each pixel in the first row of pixels may be set as display data corresponding to a lower row of pixels adjacent to the first row of pixels. That is, in one same column, the display data corresponding to the pixels in the first row of pixels may be set as display data corresponding to the second row of pixels. In some embodiments, in one same column, display data corresponding to sub-pixels in the first row of pixels may be set as display data corresponding to sub-pixels in the second row of pixels.

Display data corresponding to each pixel in the third row of pixels may be set as display data corresponding to a lower row of pixels adjacent to the third row of pixels. That is, in one same column, the display data corresponding to the pixels in the third row of pixels may be set as display data corresponding to the fourth row of pixels. In some embodiments, in one same column, display data corresponding to sub-pixels in the third row of pixels may be set as display data corresponding to sub-pixels in the fourth row of pixels.

The remaining is in the same way and so on, which is not repeated here.

(8) The driving chip drives the display panel to display the second image at the second display frame according to the received display data corresponding to the second row group and the determined display data corresponding to the first row group.

The process of displaying other images of the display panel may be referred to the above steps (3) to (8), which is not repeated here.

In some embodiments of the present disclosure, at the $(N*K-P)^{th}$ display frame, the driving chip determines the display data corresponding to the pixels other than the $(N-P)^{th}$ row group in the display panel by the following step. At the $(2K-1)^{th}$ display frame, the driving chip determines display data corresponding to each pixel in the second row group as data obtained by weighting display data corresponding to a upper row of pixels adjacent to each pixel in the second row group and display data corresponding to a lower row of pixels adjacent to each pixel in the second row group according to received display data of the $(2K-1)^{th}$ display frame.

At the $(N*K-P)^{th}$ display frame, the driving chip determines the display data corresponding to the pixels other than the $(N-P)^{th}$ row group in the display panel by the following step. At the $(2K)^{th}$ display frame, the driving chip determines display data corresponding to each pixel in the first row group as data obtained by weighting display data corresponding to an upper row of pixels adjacent to each pixel in the first row group and display data corresponding to a lower row of pixels adjacent to each pixel in the first row group according to received display data of the $(2K)^{th}$ display frame.

A driving method provided by the embodiment of the present disclosure includes the following steps.

(1) A plurality of continuous display frames of image data to be displayed are obtained.

(2) The quantity of display frames corresponding to static images and the quantity of display frames corresponding to dynamic images in a plurality of adjacent display frames in a plurality of display frames are determined.

(3) When it is determined that the quantity of the display frames corresponding to the dynamic images is greater than the quantity of the display frames corresponding to the static images, when the first display frame in the plurality of display frames is transmitted, display data corresponding to each pixel in a first row group is transmitted to a driving chip in a display panel.

(4) The driving chip determines display data corresponding to each pixel in the second row group as data obtained by weighting display data corresponding to an upper row of pixels adjacent to each pixel in the second row group and display data corresponding to a lower row of pixels adjacent to each pixel in the second row group according to the received display data of the first display frame.

In some embodiments, display data corresponding to each pixel in the second row of pixels may be set as data obtained by weighting display data corresponding to an upper row of pixels adjacent to the second row of pixels and display data corresponding to a lower row of pixels adjacent to the second row of pixels. That is, in one same column, the display data corresponding to the pixels in the second row of pixels may be set as data obtained by weighting display data corresponding to the first row of pixels and display data corresponding to the third row of pixels. In some embodiments, in one same column, display data corresponding to sub-pixels in the second row of pixels may be set as data obtained by weighting display data corresponding to sub-pixels in the first row of pixels and display data corresponding to sub-pixels in the third row of pixels.

Display data corresponding to each pixel in the fourth row of pixels may be set as data obtained by weighting display data corresponding to an upper row of pixels adjacent to the fourth row of pixels and display data corresponding to a lower row of pixels adjacent to the fourth row of pixels. That is, in one same column, the display data corresponding to the pixels in the fourth row of pixels may be set as data obtained by weighting display data corresponding to the third row of pixels and display data corresponding to the fifth row of pixels. In some embodiments, in one same column, display data corresponding to sub-pixels in the fourth row of pixels may be set as data obtained by weighting display data corresponding to sub-pixels in the third row of pixels and display data corresponding to sub-pixels in the fifth row of pixels.

The remaining is in the same way and so on, which is not repeated here.

It needs to be noted that since no other pixel is set under the last row of pixels in the second row group, display data corresponding to the last row of pixels in the second row group may not be determined, that is, the driving chip performs calculation until display data corresponding to the second to the last row of pixels in the second row group.

It needs to be noted that virtual pixels will be set in the display panel generally, that is, virtual pixels not for display are set above the first row of pixels in a display region, and virtual pixels not for display are set under the last row in the display region. The obtained display data of the plurality of display frames not only includes display data corresponding to each pixel in the display region, but also display data corresponding to each virtual pixel. In this way, in one same column, display data corresponding to pixels in the last row of pixels in the second row group may be set as data obtained by weighting display data corresponding to an upper row of pixels adjacent to the last row of pixels and display data corresponding to a lower row of virtual pixels adjacent to the last row of pixels. For example, if the display panel includes 1000 rows of pixels, in one same column, display data corresponding to the $1000^{th}$ row of pixels may be set as data obtained by weighting display data corresponding to the $999^{th}$ row of pixels and display data corresponding to a lower row of virtual pixels adjacent to the $1000^{th}$ row of pixels.

(5) The driving chip drives the display panel to display a first image at the first display frame according to the received display data corresponding to the first row group and the determined display data corresponding to the second row group.

(6) When it is determined that the quantity of the display frames corresponding to the dynamic images is greater than the quantity of the display frames corresponding to the static images, when the second display frame in the plurality of display frames is transmitted, display data corresponding to each pixel in the second row group is transmitted to the driving chip in the display panel.

(7) The driving chip determines display data corresponding to each pixel in the first row group as data obtained by weighting display data corresponding to an upper row of pixels adjacent to each pixel in the first row group and display data corresponding to a lower row of pixels adjacent to each pixel in the first row group according to the received display data of the second display frame.

In some embodiments, display data corresponding to each pixel in the third row of pixels may be set as data obtained by weighting display data corresponding to an upper row of pixels adjacent to the third row of pixels and display data corresponding to a lower row of pixels adjacent to the third row of pixels. That is, in one same column, the display data corresponding to the pixels in the third row of pixels may be set as data obtained by weighting display data corresponding to the second row of pixels and display data corresponding to the fourth row of pixels. In some embodiments, in one same column, display data corresponding to sub-pixels in the third row of pixels may be set as data obtained by weighting display data corresponding to sub-pixels in the second row of pixels and display data corresponding to sub-pixels in the fourth row of pixels.

Display data corresponding to each pixel in the fifth row of pixels may be set as data obtained by weighting display data corresponding to an upper row of pixels adjacent to the fifth row of pixels and display data corresponding to a lower row of pixels adjacent to the fifth row of pixels. That is, in one same column, the display data corresponding to the pixels in the fifth row of pixels may be set as data obtained by weighting display data corresponding to the fourth row of pixels and display data corresponding to the sixth row of pixels. In some embodiments, in one same column, display data corresponding to sub-pixels in the fifth row of pixels may be set as data obtained by weighting display data corresponding to sub-pixels in the fourth row of pixels and display data corresponding to sub-pixels in the sixth row of pixels.

The remaining is in the same way and so on, which is not repeated here.

It needs to be noted that since no other pixel is set above the first row of pixels, the display data corresponding to the first row of pixels may not be determined, that is, the driving chip performs calculation until the display data corresponding to the third row of pixels.

It needs to be noted that virtual pixels will be set in the display panel generally, that is, virtual pixels not for display are set above the first row of pixels in a display region, and virtual pixels not for display are set under the last row in the display region. The obtained display data of the plurality of display frames not only includes display data corresponding to each pixel in the display region, but also display data corresponding to each virtual pixel. In this way, in one same column, the display data corresponding to the pixels in the first row of pixels may be set as data obtained by weighting display data corresponding to an upper row of virtual pixels adjacent to the first row of pixels and a lower row of pixels adjacent to the first row of pixels. For example, if the display panel includes 1000 rows of pixels, in one same column, the display data corresponding to the first row of pixels may be set as data obtained by weighting display data corresponding to the upper row of virtual pixels adjacent to the first row of pixels and the display data corresponding to the second row of pixels.

(8) The driving chip drives the display panel to display a second image at the second display frame according to the received display data corresponding to the second row group and the determined display data corresponding to the first row group.

The process of displaying other images of the display panel may be referred to the above steps (3) to (8), which is not repeated here.

In some embodiments of the present disclosure, at the $(N*K-P)^{th}$ display frame, the driving chip determines the display data corresponding to the pixels other than the $(N-P)^{th}$ row group in the display panel by the following step. Apart from the first display frame, at the $(2K-1)^{th}$ display frame, the driving chip determines display data corresponding to each pixel in the second row group as display data of the $(2K-2)^{th}$ display frame according to received display data of the $(2K-2)^{th}$ display frame.

In the embodiment of the present disclosure, at the $(N*K-P)^{th}$ display frame, the driving chip determines the display data corresponding to the pixels other than the $(N-P)^{th}$ row group in the display panel by the following step. At the $(2K)^{th}$ display frame, the driving chip determines display data corresponding to each pixel in the first row group as display data of the $(2K-1)^{th}$ display frame according to received display data of the $(2K-1)^{th}$ display frame.

A driving method provided by the embodiment of the present disclosure includes the following steps.

(1) A plurality of continuous display frames of image data to be displayed are obtained.

(2) The quantity of display frames corresponding to static images and the quantity of display frames corresponding to dynamic images in a plurality of adjacent display frames in a plurality of display frames are determined.

(3) When it is determined that the quantity of the display frames corresponding to the dynamic images is greater than the quantity of the display frames corresponding to the static images, when the first display frame in the plurality of display frames is transmitted, display data corresponding to each pixel in the first row group is transmitted to a driving chip in a display panel.

(4) The driving chip determines display data corresponding to each pixel in the second row group as display data corresponding to an upper row of pixels adjacent to each pixel in the second row group according to the received display data of the first display frame.

In some embodiments, display data corresponding to each pixel in the second row of pixels may be set as display data corresponding to an upper row of pixels adjacent to the second row of pixels. That is, in one same column, the display data corresponding to the pixels in the second row of pixels may be set as display data corresponding to the first row of pixels. In some embodiments, in one same column, display data corresponding to sub-pixels in the second row of pixels may be set as display data corresponding to sub-pixels in the first row of pixels.

Display data corresponding to each pixel in the fourth row of pixels may be set as display data corresponding to an upper row of pixels adjacent to the fourth row of pixels. That is, in one same column, the display data corresponding to the pixels in the fourth row of pixels may be set as display data corresponding to the third row of pixels. In some embodiments, in one same column, display data corresponding to sub-pixels in the fourth row of pixels may be set as display data corresponding to sub-pixels in the third row of pixels.

The remaining is in the same way and so on, which is not repeated here.

(5) The driving chip drives the display panel to display the first image at the first display frame according to the received display data corresponding to the first row group and the determined display data corresponding to the second row group.

(6) When it is determined that the quantity of the display frames corresponding to the dynamic images is greater than the quantity of the display frames corresponding to the static images, when the second display frame in the plurality of display frames is transmitted, display data corresponding to each pixel in the second row group is transmitted to the driving chip in the display panel.

(7) The driving chip determines display data corresponding to each pixel in the first row group as display data of the first display frame according to the received display data of the first display frame.

In some embodiments, according to that the received display data of the first display frame has the display data corresponding to each pixel in the first row group, the driving chip may determine, at the second display frame, the display data of the first display frame as the display data corresponding to each pixel in the first row group. In this way, the calculating amount may be lowered.

(8) The driving chip drives the display panel to display the second image at the second display frame according to the received display data corresponding to the second row group and the determined display data corresponding to the first row group.

(9) When it is determined that the quantity of the display frames corresponding to the dynamic images is greater than the quantity of the display frames corresponding to the static images, when the third display frame in the plurality of display frames is transmitted, display data corresponding to each pixel in the first row group is transmitted to the driving chip in the display panel.

(10) The driving chip determines display data corresponding to each pixel in the second row group as display data of the second display frame according to the received display data of the second display frame.

In some embodiments, according to that the received display data of the second display frame has the display data corresponding to each pixel in the second row group, the driving chip may determine, at the third display frame, the display data of the second display frame as the display data corresponding to each pixel in the second row group. In this way, the calculating amount may be lowered.

(11) The driving chip drives the display panel to display the second image at the second display frame according to the received display data corresponding to the second row group and the determined display data corresponding to the first row group.

The process of displaying other images of the display panel may refer to the above steps (3) to (8), which is not repeated here.

Figure 4:
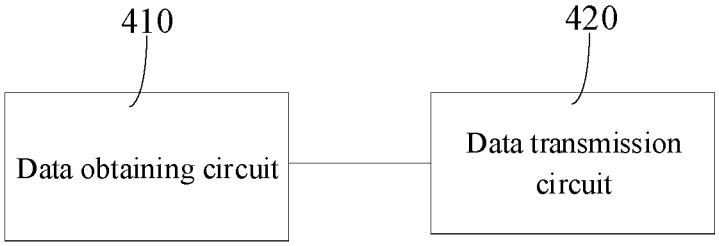
FIG. 4 is a schematic structural diagram of a driving apparatus in an embodiment of the present disclosure.

Based on the same inventive concept, an embodiment of the present invention provides a driving apparatus of a display panel, and as shown in FIG. 4, the driving apparatus may include:

a data obtaining circuit 410, configured to obtain a plurality of continuous display frames of image data to be displayed. Each display frame of image data includes display data corresponding to each pixel; and a data transmission circuit 420, configured to, when each of the plurality of display frames is transmitted, transmit only display data, corresponding to each pixel in one row group, of the display frames of image data to the driving chip in the display panel, so that a driving chip in the display panel drives the display panel to display an image according to the received display data.

In some embodiments, the data obtaining circuit and the data transmission circuit in the embodiment of the present invention may adopt the form of a complete hardware embodiment, a complete software embodiment or a software and hardware combined embodiment.

In some embodiments, the driving apparatus of the display panel in the embodiment of the present invention may be set as a system on chip.

Based on the same inventive concept, an embodiment of the present invention further provides a liquid crystal display panel, including an opposite substrate and an array substrate disposed oppositely, and a liquid crystal layer located between the opposite substrate and the array substrate. The array substrate is any of the above array substrate provided by an embodiment of the present invention. The principle for solving problems of the liquid crystal display panel is similar to the aforementioned array substrate, and thus implementation of the liquid crystal display panel may refer to implementation of the aforementioned array substrate, and repeated parts are omitted herein.

Based on the same inventive concept, an embodiment of the present invention further provides a display apparatus, including the display panel and the driving apparatus provided by the embodiments of the present invention. The principle for solving problems of the display apparatus is similar to the aforementioned driving apparatus and driving method, and thus implementation of the display apparatus may refer to implementation of the aforementioned driving apparatus and driving method, and repeated parts are omitted herein.

In the embodiment of the present invention, the display apparatus may be: a mobile phone, a tablet computer, a television, a display, a laptop, a digital photo frame, a navigator and any product or component with a display function. Other essential components of the display apparatus shall be understood by those of ordinary skill in the art, and is omitted herein and also shall not become a restriction to the present invention.

Based on the same inventive concept, an embodiment of the present invention further provides a computer readable storage medium, storing a computer program thereon, wherein the steps of any driving method of the display panel provided by the embodiment of the present invention are implemented when the computer program is executed by a processor. In some embodiments, the present invention may adopt the form of a computer program product implemented on one or more computer available storage media (including but not limited to a disk memory, an optical memory and the like) containing computer available program codes.

Based on the same inventive concept, an embodiment of the present invention further provides a computer device, including a memory, a processor and a computer program stored on the memory and capable of running on the processor. The steps of any driving method of the display panel provided by the embodiment of the present invention are implemented when the computer program is executed by the processor.

According to the driving method and apparatus of the display panel provided by the embodiments of the present invention, when each of a plurality of obtained display frames is transmitted, only display data, corresponding to each pixel in one row group, in the display frame of image data is transmitted to the driving chip in the display panel, so that the driving chip in the display panel drives the display panel to display the image according to the received display data. Therefore, when a system on chip transmits each of the plurality of obtained display frames, only the display data, corresponding to each pixel in one row group, in the display frame of image data is transmitted to the driving chip in the display panel, so that the data size transmitted to the driving chip in the display panel may be reduced, and when the transmission rate of the system on chip does not meet requirements, the phenomenon of lagging of pictures displayed by the display panel is relieved.

Apparently, those skilled in the art can perform various changes and modifications on the invention without departing from the spirit and scope of the invention. Therefore, if these changes and modifications on the invention fall in the scope of the claims of the invention and their equivalent technologies, the invention is also intended to contain these changes and modifications.

What is claimed is:

1. A driving method of a display panel, wherein the display panel comprises a plurality of rows of pixels, the plurality of rows of pixels are divided into N row groups, each of the row groups comprises pixels spaced by N−1 rows, and N is an integer greater than 1; and the driving method comprises:

obtaining a plurality of continuous display frames of image data to be displayed, wherein each of the plurality of display frames of image data comprises display data corresponding to each of the pixels;

in a condition that an $(N*K-P)^{th}$ display frame in the plurality of display frames is transmitted, transmitting display data, corresponding to each pixel in only $(N-P)^{th}$ row group in the N row groups, of the $(N*K-P)^{th}$ display frame to a driving chip in the display panel, wherein $0 \le P \le N-1$, K is an integer greater than 0, and P is an integer;

at the $(N*K-P)^{th}$ display frame, determining, by the driving chip, display data corresponding to pixels other than the $(N-P)^{th}$ row group in the display panel; and driving, by the driving chip, the display panel to display an image at the $(N*K-P)^{th}$ display frame according to the received display data corresponding to the $(N-P)^{th}$ row group and the determined display data;

wherein N=2; the 2 row groups comprise a first row group and a second row group, the first row group comprises the odd rows of pixels, and the second row group comprises the even rows of pixels; and at the $(N*K-P)^{th}$ display frame, determining, by the driving chip, the display data corresponding to the pixels other than the $(N-P)^{th}$ row group in the display panel, comprises:

at a $(2K-1)^{th}$ display frame, determining, by the driving chip, display data corresponding to each pixel in the second row group as display data corresponding to an upper row of pixels adjacent to each pixel in the second row group according to received display data of the $(2K-1)^{th}$ display frame; or at a $(2K-1)^{th}$ display frame, determining, by the driving chip, display data corresponding to each pixel in the second row group as data obtained by weighting display data corresponding to an upper row of pixels adjacent to each pixel in the second row group and display data corresponding to a lower row of pixels adjacent to each pixel in the second row group according to the received display data of the $(2K-1)^{th}$ display frame; or apart from a first display frame, at a $(2K-1)^{th}$ display frame, determining, by the driving chip, display data corresponding to each pixel in the second row group as display data of a $(2K-2)^{th}$ display frame according to received display data of the $(2K-2)^{th}$ display frame.

2. The driving method according to claim 1 wherein:

in a condition that a $(2K)^{th}$ display frame in the plurality of display frames is transmitted, transmitting display data corresponding to each pixel in the second row group to the driving chip in the display panel; and in a condition that a $(2K-1)^{th}$ display frame in the plurality of display frames is transmitted, transmitting display data corresponding to each pixel in the first row group to the driving chip in the display panel.

3. The driving method according to claim 1, further comprising:

determining a quantity of display frames corresponding to static images and a quantity of display frames corresponding to dynamic images in a plurality of adjacent display frames in the plurality of display frames;

wherein in a condition that an $(N*K-P)^{th}$ display frame in the plurality of display frames is transmitted, transmitting display data, corresponding to each pixel in only $(N-P)^{th}$ row group in the N row groups, of the $(N*K-P)^{th}$ display frame to the driving chip in the display panel, comprises:

in a condition that it is determined that the quantity of the display frames corresponding to the dynamic images is greater than the quantity of the display frames corresponding to the static images, and in the condition that the $(N*K-P)^{th}$ display frame in the plurality of display frames is transmitted, transmitting display data, corresponding to each pixel in only $(N-P)^{th}$ row group in the N row groups, of the $(N*K-P)^{th}$ display frame to the driving chip in the display panel.

4. A driving apparatus of a display panel, wherein the display panel comprises a plurality of rows of pixels, the plurality of rows of pixels are divided into N row groups, each of the row groups comprises pixels spaced by N−1 rows, and N is an integer greater than 1; and the driving apparatus comprises data obtaining circuit and a data transmission circuit, for performing the driving method of the display panel according to claim 1.

5. A display apparatus, comprising: a display panel and the driving apparatus according to claim 4.

6. A non-transitory computer readable storage medium, storing a computer program thereon, wherein the driving method of the display panel according to claim 1 is implemented when the computer program is executed by a processor.

7. A non-transitory computer device, comprising a memory, a processor and a computer program stored on the memory and capable of running on the processor, wherein the driving method of the display panel according to claim 1 is implemented when the computer program is executed by the processor.

8. A driving method of a display panel, wherein the display panel comprises a plurality of rows of pixels, the plurality of rows of pixels are divided into N row groups, each of the row groups comprises pixels spaced by N−1 rows, and N is an integer greater than 1; and the driving method comprises:

obtaining a plurality of continuous display frames of image data to be displayed, wherein each of the plurality of display frames of image data comprises display data corresponding to each of the pixels;

in a condition that an $(N*K-P)^{th}$ display frame in the plurality of display frames is transmitted, transmitting display data, corresponding to each pixel in only $(N-P)^{th}$ row group in the N row groups, of the $(N*K-P)^{th}$ display frame to a driving chip in the display panel, wherein $0 \le P \le N-1$, K is an integer greater than 0, and P is an integer;

at the $(N*K-P)^{th}$ display frame, determining, by the driving chip, display data corresponding to pixels other than the $(N-P)^{th}$ row group in the display panel; and driving, by the driving chip, the display panel to display an image at the $(N*K-P)^{th}$ display frame according to the received display data corresponding to the $(N-P)^{th}$ row group and the determined display data;

wherein N=2; the 2 row groups comprise a first row group and a second row group, the first row group comprises the odd rows of pixels, and the second row group comprises the even rows of pixels; and at the $(N*K-P)^{th}$ display frame, determining, by the driving chip, the display data corresponding to the pixels other than the $(N-P)^{th}$ row group in the display panel, comprises:

at a $(2K)^{th}$ display frame, determining, by the driving chip, display data corresponding to each pixel in the first row group as display data corresponding to a lower row of pixels adjacent to each pixel in the first row group according to received display data of the $(2K)^{th}$ display frame; or at a $(2K)^{th}$ display frame, determining, by the driving chip, display data corresponding to each pixel in the first row group as data obtained by weighting display data corresponding to an upper row of pixels adjacent to each pixel in the first row group and display data corresponding to a lower row of pixels adjacent to each pixel in the first row group according to the received display data of the $(2K)^{th}$ display frame; or at a $(2K)^{th}$ display frame, determining, by the driving chip, display data corresponding to each pixel in the first row group as display data of a $(2K-1)^{th}$ display frame according to received display data of the $(2K-1)^{th}$ display frame.

9. The driving method according to claim 8, wherein:

in a condition that a $(2K)^{th}$ display frame in the plurality of display frames is transmitted, transmitting display data corresponding to each pixel in the second row group to the driving chip in the display panel; and in a condition that a $(2K-1)^{th}$ display frame in the plurality of display frames is transmitted, transmitting display data corresponding to each pixel in the first row group to the driving chip in the display panel.

10. The driving method according to claim 8, further comprising:

determining a quantity of display frames corresponding to static images and a quantity of display frames corresponding to dynamic images in a plurality of adjacent display frames in the plurality of display frames;

wherein in a condition that an $(N*K-P)^{th}$ display frame in the plurality of display frames is transmitted, transmitting display data, corresponding to each pixel in only $(N-P)^{th}$ row group in the N row groups, of the $(N*K-P)^{th}$ display frame to the driving chip in the display panel, comprises:

in a condition that it is determined that the quantity of the display frames corresponding to the dynamic images is greater than the quantity of the display frames corresponding to the static images, and in the condition that the $(N*K-P)^{th}$ display frame in the plurality of display frames is transmitted, transmitting display data, corresponding to each pixel in only $(N-P)^{th}$ row group in the N row groups, of the $(N*K-P)^{th}$ display frame to the driving chip in the display panel.

* * * * *